United States Patent [19]

Rothe et al.

[11] Patent Number: 4,738,847

[45] Date of Patent: Apr. 19, 1988

[54] MULTI-PLY VIRUCIDAL PRODUCT

[75] Inventors: Robert A. Rothe, Appleton, Wis.; Christopher Creagan, Marietta, Ga.; Harry L. Spiegelberg, Appleton, Wis.

[73] Assignee: Kimberly-Clark Corporation, Neenah, Wis.

[21] Appl. No.: 691,252

[22] Filed: Jan. 14, 1985

[51] Int. Cl.[4] ..... A61K 9/24; A61K 9/70; A61F 13/00

[52] U.S. Cl. ..... 424/443; 424/446; 424/447; 428/249; 162/158

[58] Field of Search ..... 428/249; 424/28, 443, 424/446, 447; 162/158

[56] References Cited

U.S. PATENT DOCUMENTS

| | | | |
|---|---|---|---|
| 131,242 | 9/1872 | Baquol | 424/27 |
| 967,688 | 8/1910 | Titherley | 424/28 |
| 1,687,625 | 10/1928 | Mackenzie | 424/28 |
| 1,687,643 | 10/1928 | Berliner | 424/27 |
| 2,688,586 | 9/1954 | Eberl et al. | 424/28 |
| 3,317,376 | 5/1967 | Schattner | 424/28 |
| 3,325,003 | 6/1967 | Bilezerian | 424/443 |
| 4,045,364 | 8/1977 | Richter | 424/28 |
| 4,349,531 | 9/1982 | Mlodozeniec et al. | 424/443 |
| 4,351,699 | 9/1982 | Osborn | 162/158 |
| 4,355,021 | 10/1982 | Mahl et al. | 424/28 |
| 4,401,712 | 8/1983 | Morrison | 424/28 |
| 4,426,418 | 1/1984 | Coleman et al. | 424/414 |
| 4,441,962 | 4/1984 | Osborn | 162/158 |
| 4,483,846 | 11/1984 | Koide et al. | 424/28 |

FOREIGN PATENT DOCUMENTS

| | | | |
|---|---|---|---|
| 8121 | 2/1980 | European Pat. Off. | 424/28 |
| 2103089 | 3/1986 | United Kingdom . | |

OTHER PUBLICATIONS

G. Poli et al., *Food Chem.* (England), 4(4), 251–258, (1979).

J. D. Reid, *Amer. J. Hygiene, 16, 540–556, (1932).*

Oxford et al., "Inactivation of Influenza and Other Viruses by a Mixture of Virucidal Compounds", Applied Microbiology, 21 (10), pp. 606–610, Apr. 1971.

*Primary Examiner*—Ronald W. Griffin

*Attorney, Agent, or Firm*—Gregory E. Croft; Donald L. Traut; Jeremiah J. Duggan

[57] ABSTRACT

A multi-ply absorbent product, such as a facial tissue, comprising a virucidal composition substantially confined to the middle of the product reduces or eliminates any stinging response associated with contacting the virucidal composition with certain sensitive parts of the body, such as the eyes and nose, yet simultaneously retains virucidal efficacy.

10 Claims, 1 Drawing Sheet

MULTI-PLY VIRUCIDAL PRODUCT

BACKGROUND OF THE INVENTION

In a commonly assigned copending application, Ser. No. 447,581, filed Dec. 13, 1982 to Hossain et al., a virucidal composition is disclosed for inactivating certain viruses which are associated with common colds, particularly adenovirus and rhinovirus. The virucidal composition preferably comprises a mixture of one or more carboxylic acids, such as citric acid and malic acid, and a surfactant such as sodium lauryl sulfate.

While experimenting with different product forms to arrive at an acceptable and virucidally effective facial tissue, it was found that the virucidal composition can cause stinging when contacting the eyes and perinasal area of the user. This was considered to be an undesirable characteristic to be eliminated or at least reduced in intensity to a more acceptable level.

SUMMARY OF THE INVENTION

It has been found that by confining the virucidal composition substantially only to the center of the tissue, the stinging sensation associated with contacting the virucidal composition with the user's eyes or skin is greatly reduced or completely eliminated, yet the virucidal effectiveness of the tissue is retained. This is surprising in that one might expect it necessary to have the virucidal composition on the outside of the tissue in order to be effective. Hence the invention resides in a multi-ply absorbent product comprising two or more plies and a virucidally effective amount of a virucidal composition, wherein said virucidal composition is substantially confined in the middle of the product. In the case of a three-ply product, which is preferred, the virucidal composition resides substantially solely in the inner ply. Products of this invention include, without limitation, facial tissues, bathroom tissues, paper towels, wipes, and the like.

Suitable virucidal compositions include, but are not limited to, those disclosed in copending application Ser. No. 447,581 filed Dec. 13, 1982 to Hossain, et al., which is hereby incorporated by reference in its entirety. These compositions include, but are not limited to, acids having the formula R-COOH, where R is selected from the group consisting of lower alkyl; substituted lower alkyl; carboxy lower alkyl; carboxy hydroxy lower alkyl; carboxy halo lower aklyl; carboxy dihydroxy lower alkyl; dicarboxy hydroxy lower alkyl; lower alkenyl; carboxy lower alkenyl; dicarboxy lower alkenyl; and phenyl and substituted phenyl groups. R is preferably selected from the group consisting of carboxy hydroxy lower alkyl, carboxy dihydroxy lower alkyl, and dicarboxy hydroxy lower alkyl groups. Also included are surfactant(s) and/or combinations of acid(s) and surfactant(s), preferably combinations of acid(s) and anionic surfactant(s). Preferred virucidal compositions include citric acid, malic acid, mixtures of citric acid and malic acid, and combinations of these acid(s) with sodium lauryl sulfate. Other virucidal compositions can also be used provided they are safe and effective.

For purposes herein, "virucidally effective amount" means an amount sufficient to inactivate 99 percent (2 log drop) of rhinovirus type 16 within 10 minutes. A suitable method for testing virucidal efficacy is the Virucidal Assay Procedure disclosed in the abovesaid copending application, although those skilled in the art of virology will recognize other suitable test procedures for this purpose. The amount of the virucidal composition in the product will depend on the efficacy of the virucide. Generally speaking, there will be at least about 2 air dry weight percent of the virucidal composition in the product when the virucidally active ingredients are carboxylic acids.

"Substantially confined to the middle of the product" means that the virucidal composition is concentrated between the two outer surfaces of the product to the extent that very little of the virucidal composition, if any, is present on either of the two outer surfaces. A product having this construction avoids or greatly reduces any undesirable consequences, such as stinging, which may result from the presence of virucide on the surface of the product. For example, in a three-ply product, this is easily accomplished by applying the virucidal composition to the inner ply and substantially drying the inner ply before sandwiching the treated inner ply between the two outer plies. Generally speaking, at least about 70% weight percent of the virucidal composition should remain in the inner ply. In a two-ply product, the virucidal composition can be applied to either or both of the inner surfaces of the two plies before they are combined, but only to the extent there is minimal migration of the virucidal composition to the outer surface of the two-ply product. Preferably, when the virucidal composition comprises acids, the outer surfaces of the multi-ply product should each contain less than about 1 mg. of the virucidal composition per square inch. For a two-ply product this will be difficult to achieve with untreated individual plies having a basis weight of less than about 20 pounds of fiber per 2880 square feet when using aqueous virucidal compositions. Lower basis weights can more readily be employed when using a relatively light application of a virucidal composition to the inner surface of at least one of the two plies, or by treating the inner surface with a water-repellent prior to applying an aqueous virucidal composition to prevent migration of the virucide to the outer surface. Alternatively, if the virucidal composition has a sufficiently high viscosity or consistency, the ply may not quickly absorb the virucidal composition and thereby substantially confine it to the inner surface of the ply.

The plies comprising the products of this invention are preferably webs of cellulosic creped wadding, as are commonly used for making tissues and paper towels, which can be either wet laid or air laid. However, nonwoven webs of synthetic polymeric fibers, such as polypropylene or polyethylene, or of mixtures of synthetic fibers and cellulosic fibers, can also be used.

DETAILED DESCRIPTION OF THE DRAWING

Figure 1:
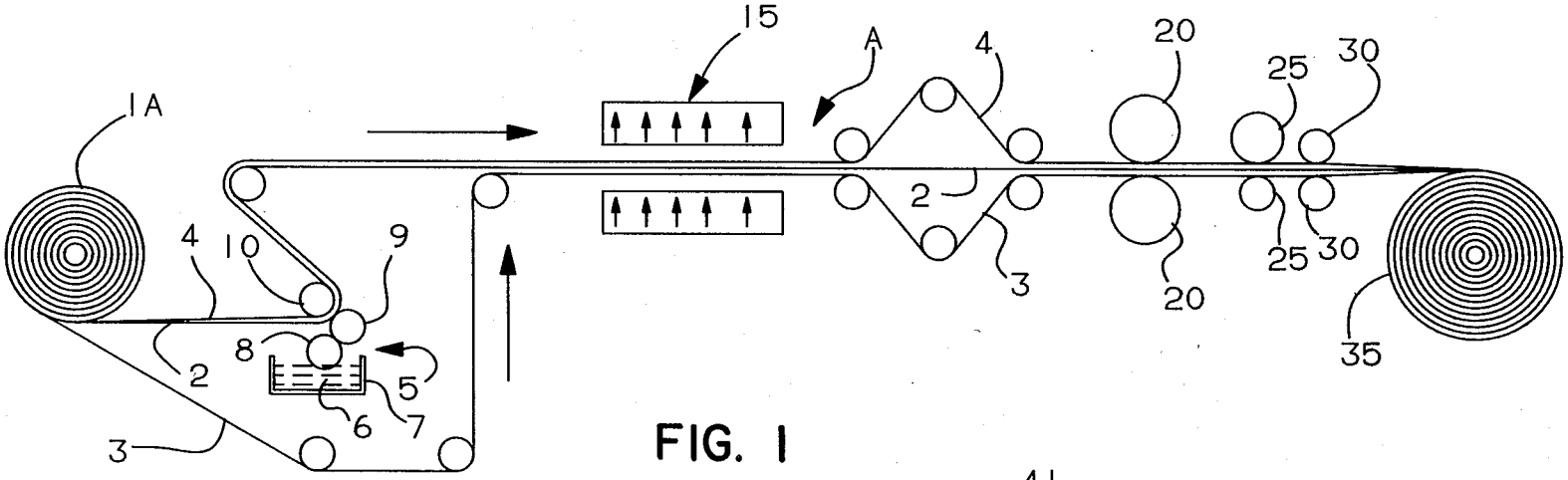
FIG. 1 illustrates one example of a schematic flow diagram for making a product of this invention.

Directing attention to FIG. 1, an example of a method for making the product of this invention is illustrated. Three plies of creped wadding were unwound from a single roll 1A at a speed of 1000 ft/min. Each of the plies had a basis weight of 9 pounds per 2880 square feet. In order to apply the virucidal composition to the inner ply 2, one of the outer plies 3 was separated from plies 2 and 4 as illustrated.

Plies 2 and 4 were passed through a Dahlgren liquid application system 5 which printed a metered amount of the virucidal composition onto the inner ply 2. The virucidal composition 6 consisted of a solution containing 37.4 weight percent citric acid, 18.7 weight percent malic acid, 7.5 weight percent sodium lauryl sulfate, and 63.4 weight percent water. The Dahlgren unit comprised a solution reservoir 7, a metering roll 8, a transfer roll 9, and a back-up roll 10. Virucidal solution was picked up by the metering roll, transferred to the transfer roll, and applied to the center ply in a nip between the transfer roll and the back-up roll. The dry virucidal composition solids add-on, based on the air dry weight of the center ply 2, was about 6.1 mg. per square inch. It will be appreciated that the solids add-on rate must be adjusted for the particular virucidal composition being used. Also, there will naturally be some bleed-through or migration of the virucidal solution to the outer plies 4 and 3 during and after printing due to the absorbent character of the plies and the low viscosity of the virucidal solution. However, the amount of migration or bleed-through is to be minimized in order to minimize stinging sensation which may be detected by the consumer during normal use of the product. That portion of the virucidal composition which does bleed through to the outer ply 4 is preferably concentrated near the inner surface of the outer ply 4. Application of the virucidal composition can be accomplished by means other than printing, such as spraying, extrusion, foam application, or dipping, but printing is preferred because it offers the greatest amount of control for applying this particular virucidal composition.

After applying the virucidal composition to the center ply 2, the outer ply 3 was recombined with the other two plies and the three plies were passed through a flat bed throughdrier 15. Hot air having a temperature of 260° F. and a flow rate of 20,000 $ft^3$/min. was supplied to the throughdrier to dry the three-ply product. (Although not illustrated in FIG. 1, in actually carrying out the overall process depicted the three plies were wound up on a roll after drying (at point "A" in FIG. 1) due to in-line equipment limitations and were later unwound and reintroduced into the overall process at the same point "A" to be further processed as shown.)

Because the specific virucidal solution used had a tendency to migrate from the inner to the outer plies and adhere the inner ply to the two outer plies during drying commonly referred to as ("blocking"), after drying the three plies were separated and thereafter recombined. This operation eliminated the blocking problem and reduced the stiffness of the composite sheet.

The recombined three-ply web was then calendered by passing through a pair of calender rolls 20 to achieve proper caliper and to improve the desired bulk and smoothness characteristics. After calendering, the three-plies were crimped together by suitable crimp rolls 25 and slit by suitable slitters 30 to a suitable width and wound onto a roll 35 for converting and packaging into facial tissues in a conventional manner.

Figure 2:
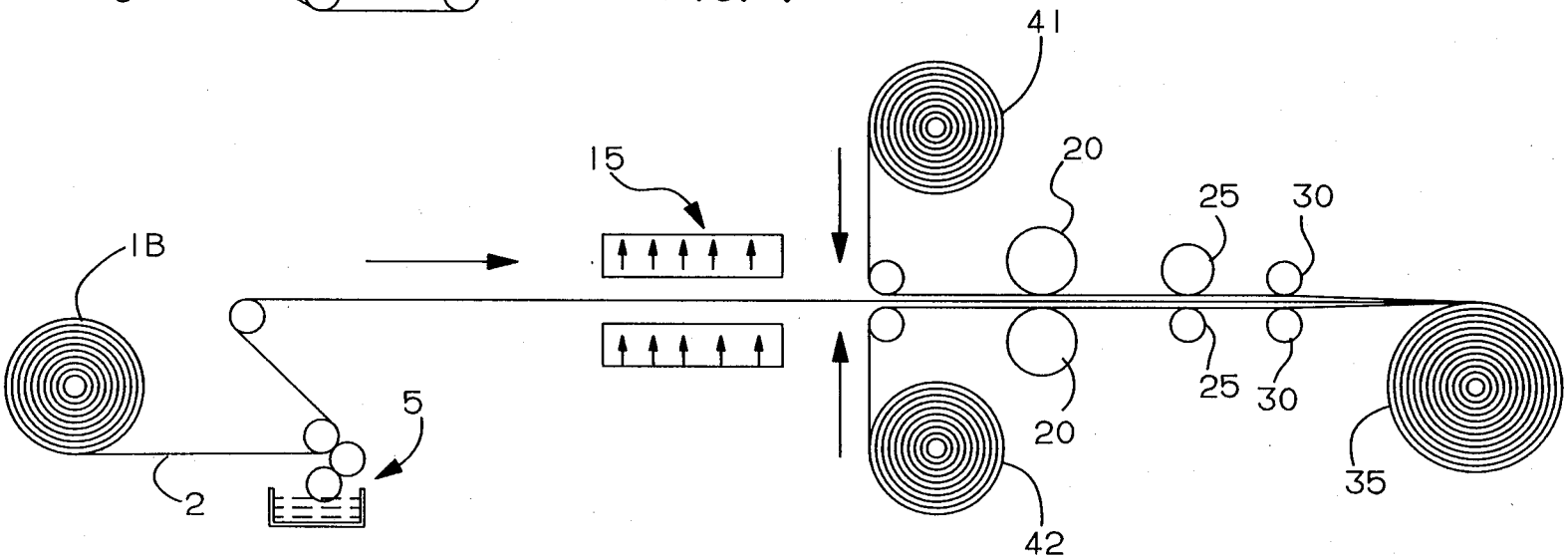
FIG. 2 illustrates an alternative preferred method of making a product of this invention.

In must be appreciated that certain of the foregoing process steps were dictated by equipment limitations which are peculiar to the facilities used to produce the facial tissue product and are not limitations of this invention. For example, FIG. 2 illustrates a simplified process in which a single ply 2 to be treated with a virucidal composition is unwound from a supply roll 1B and treated with the virucidal composition, as by printing, extruding, or spraying the virucidal composition on one or both surfaces of the ply. The treated ply is then dried and sandwiched between two untreated plies supplied from supply rolls 41 and 42. The 3-ply composite web is then calendered, crimped, slit, and wound onto a roll for subsequent converting as illustrated. By treating and drying the inner ply independently of the outer two plies, the potential blocking problem described above is avoided.

EXAMPLES

EXAMPLE 1

Virucidal Effectiveness

In order to illustrate the effectivness of the products of this invention, three-ply facial tissues were produced as described in the discussion of FIG. 1 which contained a virucidal composition substantially confined to the center ply. (hereinafter referred to as the "0-1-0" product to indicate no virucidal treatment on the outer plies and all of the virucidal treatment applied to the center ply). As described, the virucidal composition was applied to the center ply and consisted of an aqueous mixture of citric acid, malic acid, and sodium lauryl sulfate. The tissues were tested for virucidal effectiveness in the manner described by the "Virucidal Assay Procedure" set forth in the specification of the previously named copending application Ser. No. 447,581. The results are set forth in the following Table 1:

TABLE 1

VIRUCIDAL EFFECTIVENESS OF 0-1-0 PRODUCT (EXPOSURE TIME OF ONE MINUTE)

| Virus | Virus Recovered $Log_{10}TCID_{50}$ (Control Tissue) | Virus Recovered $Log_{10}TCID_{50}$ (0-1-0) | Log Drop |
|---|---|---|---|
| Adenovirus type 5 | 5.7 | ≦1.2 | ≧4.5 |
| Parainfluenza type 2 | 4.45 | ≦1.2 | ≧3.25 |
| Parainfluenza type 3 | 5.95 | ≦1.2 | ≧4.75 |
| Influenza A | 5.7 | ≦1.2 | ≧4.5 |
| Influenza B | 6.45 | ≦1.2 | ≧5.25 |
| Reovirus type 3 | 5.7 | ≦1.2 | ≧4.5 |
| Rhinovirus type 10 | 4.45 | ≦1.2 | ≧3.25 |
| Rhinovirus type 13 | 4.7 | ≦1.2 | ≧3.5 |
| Rhinovirus type 15 | 4.7 | ≦1.2 | ≧3.5 |
| Rhinovirus type 16 | 4.7 | ≦1.2 | ≧3.5 |

The foregoing Table 1 illustrates the virucidal effectiveness of the 0-1-0 facial tissue product of this invention against a broad spectrum of viruses. By comparison, the Control Tissue, which was a three-ply facial tissue of equal basis weight not containing any virucidal composition, was ineffective against all of the viruses tested. Hence in spite of substantially confining the virucidal composition to the center ply, the virucidal efficacy was maintained.

EXAMPLE 2

Reduction of Stinging

In order to test and illustrate the effectiveness of the products of this invention for reducing the stinging response of the same virucidal composition used for Table 1, a panel twelve qualified volunteer subjects was assembled. The qualified subjects were pre-screened to ensure that each individual could reliably distinguish a sting response.

Two products for testing were prepared. Product "A" was a three-ply facial tissue having an amount of a virucidal composition which was applied equally to the two outer plies. None of the virucidal composition was applied to the center ply. Product "B" was a three-ply facial tissue of this invention, wherein all of an equal amount of the virucidal composition was applied to the center ply. The particular virucidal composition used was a mixture of citric acid, malic acid, and sodium lauryl sulfate. The ratio of citric acid to malic acid was about 2:1 and the total amount of acid in the product was about 4.5 mg. per square inch. The total amount of sodium lauryl sulfate was about 0.5 mg. per square inch.

During product evaluation, the subjects were brought to a state of profuse sweating by means of an environmental chamber set at 120° F. and 40% relative humidity. The nasolabial folds and cheeks of the subjects were then thoroughly wet with distilled water and wiped with one tissue Product on each side of their face for 15 seconds while turning the Product over to maximize contact. Subjects were interrogated at 30 second intervals for a period of five (5) minutes and asked to rate the intensity of stinging using a four point ordinal scale; 0=no stinging; 1=slight stinging; 2=moderate stinging; and 3= severe stinging. One tissue product was tested at a time. Half the subjects were tested with Product A first followed at least 72 hours later by Product B. The remainder of the panelists were tested with Product B first followed at least 72 hours later by Product A. The cumulative score results are tabulated below in Table 2:

TABLE 2

TOTAL CUMULATIVE SCORE OF TWELVE TEST SUBJECTS RATING STINGING INTENSITY OF TISSUES AS A FUNCTION OF TIME

| | Time (Minutes) | | | | | | | | | |
|---|---|---|---|---|---|---|---|---|---|---|
| Product | ½ | 1 | 1½ | 2 | 2½ | 3 | 3½ | 4 | 4½ | 5 |
| A | 10 | 13 | 12 | 14 | 12 | 9 | 11 | 9 | 9 | 8 |
| B | 0 | 0 | 0 | 0 | 0 | 0 | 0 | 0 | 0 | 0 |

These results show that not one of the test subjects detected any stinging over a five minute time period when testing Product B, which is a product of this invention. On the other hand, Product A induced a stinging response from seven of the twelve subjects, for which the individual test subject responses varies between "no stinging" and "severe stinging". Hence the improvement in reducing the stinging response by the product of this invention is clearly illustrated. Therefore the combined results of Tables 1 and 2 illustrate that the products of this invention possess both virucidal efficacy and reduced stinging.

We claim:

1. A facial tissue comprising three cellulosic plies and a virucidally effective amount of a virucidal composition, wherein said virucidal composition is dry and substantially confined to the center ply and wherein said virucidal composition comprises an acid selected from the group consisting of citric acid, malic acid, and mixture of citric acid and malic acid.

2. The facial tissue of claim 1 wherein the acid is citric acid.

3. The facial tissue of claim 1 wherein the acid is malic acid.

4. The facial tissue of claim 1 wherein the acid is a mixture of citric acid and malic acid.

5. The facial tissue of claim 2, 3, or 4 further comprising sodium lauryl sulfate.

6. The tissue of claim 1 wherein the amount of the virucidal composition is about 2 air dry weight percent or greater, based on the air dry weight of the tissue.

7. A facial tissue comprising three cellulosic plies and a virucidally effective amount of a virucidal composition, wherein said virucidal composition is dry and substantially confined to the center ply and wherein said virucidal composition comprises a carboxylic acid and a surfactant.

8. The tissue of claim 7 wherein the surfactant is an anionic surfactant.

9. The tissue of claim 8 wherein the surfactant is sodium lauryl sulfate.

10. The tissue of claim 7 wherein the amount of the virucidal composition is about 2 air dry weight percent or greater, based on the air dry weight of the tissue.

* * * * *

UNITED STATES PATENT AND TRADEMARK OFFICE

CERTIFICATE OF CORRECTION

PATENT NO. : 4,738,847

DATED : April 19, 1988

INVENTOR(S) : Robert A. Rothe; Christopher Creagan; Harry L. Spiegelberg

It is certified that error appears in the above-identified patent and that said Letters Patent is hereby corrected as shown below:

Column 3, line 9, delete "63.4" and substitute therefor --36.4--.

Column 3, line 63, delete "In" and substitute therefor --It--.

Column 4, line 68, add the word "of" before the word "twelve."

Column 5, line 27, delete ";" and substitute therefor--:--.

Signed and Sealed this

Fifteenth Day of May, 1990

*Attest:*

HARRY F. MANBECK, JR.

*Attesting Officer*

*Commissioner of Patents and Trademarks*